US006894617B2

(12) United States Patent
Richman

(10) Patent No.: US 6,894,617 B2
(45) Date of Patent: May 17, 2005

(54) HUMAN GUARD ENHANCING MULTIPLE SITE INTEGRATED SECURITY SYSTEM

(75) Inventor: Lawrence Richman, La Mesa, CA (US)

(73) Assignee: Richman Technology Corporation, San Diego, CA (US)

( * ) Notice: Subject to any disclaimer, the term of this patent is extended or adjusted under 35 U.S.C. 154(b) by 286 days.

(21) Appl. No.: 10/139,110

(22) Filed: May 4, 2002

(65) Prior Publication Data

US 2003/0206099 A1 Nov. 6, 2003

(51) Int. Cl.[7] ..... G08B 23/00

(52) U.S. Cl. ..... 340/573.1; 340/541; 340/539.1; 345/7

(58) Field of Search ..... 340/573.1, 541, 340/506, 539.1, 539.11, 539.14, 539.17, 539.22, 3.1, 5.2; 345/7

(56) References Cited

U.S. PATENT DOCUMENTS 3,736,561 A * 5/1973 Rumpel ..... 340/825.22
5,623,258 A * 4/1997 Dorfman ..... 340/10.41
5,825,283 A 10/1998 Camhi ..... 340/438
6,097,429 A 8/2000 Seeley et al. ..... 348/154
6,154,133 A 11/2000 Ross et al. ..... 340/541
6,204,762 B1 * 3/2001 Dering et al. ..... 340/541
6,342,915 B1 * 1/2002 Ozaki et al. ..... 348/61
6,456,261 B1 * 9/2002 Zhang ..... 345/8
6,658,348 B2 * 12/2003 Rudd et al. ..... 701/207
6,720,874 B2 * 4/2004 Fufido et al. ..... 340/541

* cited by examiner

*Primary Examiner*—Phung Nguyen
(74) *Attorney, Agent, or Firm*—Richard D. Clarke

(57) ABSTRACT

A guard enhancing multiple site, readily scalable security system combines human-based security personnel with a diverse array of fixed and movable electronic security enhancing components, and numerous modes of communications between said components, including hard wired and wireless applications. The security related components include event sensors, identification tracking for people and things, access control devices, security guard wearable computers and hand held computers as well as embedded data processing control and communications systems, with all sensors and sites capable of being monitored by a designated headquarters through checkpoint data processing components and base station components. The security system provides better trained security guards, who are more alert and responsive, and more closely supervised and easily scheduled, enhanced financial monitoring, more accurately paid and expensed security services, better archived and reported security related events, as well as being better coordinated with public agencies, enhanced safety, and readily upgraded and integrated with existing and future technologies. The primary goal of the system configuration is to make human security guard tour tasks planned, controlled, monitored, recorded and paid in a highly efficient and effective manner.

45 Claims, 7 Drawing Sheets

HUMAN GUARD ENHANCING MULTIPLE SITE INTEGRATED SECURITY SYSTEM

BACKGROUND OF THE INVENTION

1. Field of the Invention

The present invention relates to a guard enhancing multiple site integrated security system and method of making same. More particularly, the present invention relates to a human security guard oriented system of security service and monitoring, which provides human security guards with the latest technology to make them more intelligent and responsive within a complex interactive environment.

2. Description of the Related Art

In addition to traditional threats to security such as burglary, vandalism and arson, today's complex national and international political conflicts are putting increased pressure on facilities and organizations of all kinds to provide effective security systems for the safety and protection of personnel, property and surroundings.

Devices and systems for the provision of safety and security of persons and property are well known. Examples of different types and kinds of security systems for protection and surveillance methods of building structures and surrounding areas are disclosed in U.S. Pat. Nos. 6,204,762 B1, 6,154,133, 6,097,429, and 5,825,283.

In general, the structure and function of most security systems involves electronic surveillance equipment monitored at a centralized location. Current development of security systems attempts to do away with human-oriented services and replace the human security guard with high technology solutions to security problems. Only a limited number of currently developed security systems utilize a combination of guards in close conjunction with the electronic equipment. Most of the time, these systems involve one guard who monitors a video feed or alarm panel for intrusion or other related alerts. These security systems are commonly built, installed and implemented without any regard for the particular facilities of other systems, for example, the facilities of built-in environmental and climate control, the tracking of people and assets within the building or complex, and fire/smoke detection as well as transport systems such as elevators, etc.

Therefore, it would be highly desirable to have a new and improved security system which not only enhances the human security guard services, but also integrates facilities management, and allows for identification and global positioning satellite (GPS) tracking of people as well as assets such as computers, and other valuable instrumentation, all in a readily scalable configuration utilizing off the shelf electronic security and communications components.

An electronic surveillance system for remote guarding of an area using an operator station including a signal receiver with television display, radiant energy selection control, and energy level controller is known in the prior art. Such a device is described in U.S. Pat. No. 6,204,762 B1. The novel invention remotely controls and directs an apparatus "weapon" for integration with traditionally secured facilities, remote detection devices, closed circuit TV, and a remotely-located, manned control station. While such a computerized system is helpful in detection of unauthorized personnel in a given area and does seek to incorporate pre-existing security devices, there is no provision which would allow for the irreplaceable and highly effective presence of human security guards, guards that are further enhanced by electronic wireless communications and monitoring.

Additionally, the entire system depends upon the installation and presence of numerous hard wired security devices in a given area and is not readily scalable to incorporate larger areas in the surveillance area in a short period of time without "weapon" used as a deterrent to intruders is not confined to any given space and might pose a threat to anyone, including authorized individuals, within hearing distance.

Therefore, it would be highly desirable to have a new and improved enhanced security guard system which would allow for computerized and wireless communications and monitoring of human security guards and their activities with a centralized location, in addition to conventional security devices and which would be scalable with minimal time and material expenditure, and which would provide for human guards to act as a more rapid and effective deterrent to intruders.

The exit guard system described in U.S. Pat. No. 6,154,133 addresses the requirements of providing areas with detection of movement of a subject along an exit path in an unauthorized direction. This system further provides for a human monitor at a centralized location with added supervision of the deactivation of the security alarm system only by authorized personnel.

However, within this system there is no human security guard on site actively patrolling the area. This electronically augmented human presence is irreplaceable as a deterrent to potential intruders as well as providing for flexibility in terms of monitoring and responding to a variety of situations that might arise.

Therefore, it would be highly desirable to have a new and improved, technologically augmented human presence automatically reporting to a centralized location, or a remote monitoring station through communications over a global computer network or via satellite link, which could then monitor and record guard activities as well as utilize pre-existing event detection technology, such as motion, video and perimeter control devices to alert those guards of real time events taking place on their shift.

U.S. Pat. No. 6,097,429 describes a relatively sophisticated security system utilizing video images obtained from a plurality of cameras relayed to a site control unit equipped with an automated image processor. The images are then relayed to a security system operator who then analyzes the images and informs authorities of an intrusion.

While this system utilizes advanced technological features to distinguish between actual intrusions and false alarms (friend or foe), the absence of a human guard which would serve to discourage intrusions is notably absent. Moreover, the presence of human guards makes those that are present within the facility feel protected and well taken care of, and these individuals will often speak to the security guards or become familiar with them to avoid any misunderstanding as to their access authorization or the like.

Additionally, the highly automated image processor and related complex software used to differentiate between actual foe intrusions and friendly false alarms is inherently limited in its capability to observe, compare and react to the myriad of potential one time or entirely novel situations which might occur. This type of security monitoring can only be accomplished with highly trained, well equipped, and competently supervised human security guards on duty in numbers corresponding to the amount of space or activity required to be secure from outside threats.

Therefore, it would be highly desirable to have a new and improved system for technological augmentation of human guards who are irreplaceable in terms of providing a deterrent to intrusion and who are capable of observing, assessing and responding to novel and unusual situations and whose actions would automatically be reported to a centralized headquarters with integrated automated daily events and incident real time reporting.

Finally, U.S. Pat. No. 5,825,283 provides for an apparatus for monitoring subjects having a location determining device which provides the location of the subject to a processor. The processor then stores and retrieves data generated or received by the processor. The primary means by which the subject is tracked is by usage of a GPS. Comparison of the parameters of given geographical boundaries to the data from the location determining device may determine if the subject has deviated from those parameters. The claimed invention mandates detection of at least one physiological parameter of the subject in order to compare existing subject data previously stored.

This imaginative invention does provide for tracking and determination of the general area in which a subject is to be found and a means by which to compare the location with a pre-determined geographic location. Unfortunately, while the location and tracking device may show a general area in which the subject is located, there is no way of determining the exact location of the subject at any given point in time.

In addition, this system again depends upon a complex processor which must be programmed with any number of parameters. The system may fail to operate properly or may not operate at all if incorporated into a pre-existing security system, especially one having less complex processors available on site.

Therefore, it would be highly desirable to have a new and improved system for technological augmentation of human guards automatically reporting exact location and time to a centralized headquarters with daily events and incident reporting automation which could give exact locations and time records of movement of the guards which would readily incorporate pre-existing hardware and software. Moreover, it would be highly desirable to enable said guards to wear a garment which would incorporate a wireless communications apparatus, or have said guards carry hand-held computers for this purpose.

SUMMARY OF THE INVENTION

It is therefore an object of the instant invention to provide a multiple site, integrated security system which incorporates and enhances the performance of human guards within said security system. The invaluable human presence acts as a deterrent and provides the irreplaceable human capability to observe, assess, coordinate, and react instantaneously to unusual and immediate circumstances.

It is another object of the instant invention to provide the human guards with the latest technology, in the form of wearable and hand held computers or other data processors capable of wireless communications, in order to make the guards more intelligent and responsible to the guarded facilities complex interactive environment.

Another object of the instant invention is to provide a system which would be flexible in incorporating new technology and pre-existing hardware equipment thus providing a high level of integration with off the shelf security devices now existing or not yet conceived.

It is a further object of the instant invention to provide a system of security which is able to be custom configured and scaled up or down, by being individually tailored to site conditions such as site component configurations, check-point locations, building type material, building transportation systems, facilities environmental control systems, such as climate control, fire and smoke detection, and other varied parameters.

Yet another object of the present invention is to provide a system which would automatically monitor and control certain movable and fixed site conditions such as people and vehicles at checkpoints, safety systems, access control systems, position sensors, transportation control systems, power supply systems, water and hydraulic control systems, warning systems, lighting systems, communications systems and miscellaneous site-specific systems such as greenhouse temperature controls.

Still another object of the instant invention is to provide a system for security which monitors the identification and authorization of personnel inside secured areas through use of a two points access subsystem composed of a fixed device installed at a checkpoint and a mobile device (wearable or hand held) carried by authorized personnel which could be configured to integrate pre-existing security systems without modification of the core program.

Another object of the instant invention is to provide a guard activity and real time reporting support system which includes a scheduled building and real time guard tour tracking system.

Yet another object of the instant invention is to provide a system whereby bi-directional data and command transmission may occur between a base station (computer or server configuration) and any designated person or group of persons, which enables assistance deployment and transmits the location of the person, group of persons, security guards and/or guard vehicles.

A further object of the instant invention is to provide a system which records real-time object identification and tracking subsystems for indoor and outdoor areas.

Another object of the present invention is to provide a site video monitoring system which will be recorded, transmitted and displayed at a base station (computer or server configuration) with the option of video data processing, to recognize and alert of certain predetermined events, such as access verification, etc.

Still another object of the invention is to provide a system which may integrate pre-existing hardware into the system without requiring purchase of redundant hardware.

Yet another object of the invention is to provide a system whereby there is automation of communication between base station and headquarters and between base station and any other specified person.

It is also another object of the present invention to provide a system which would automate time sheets, payroll recap and other accounting operations.

It is another object of the present invention to provide a system which provides availability of site level information from a centralized headquarters, or remotely away from a centralized headquarters.

Still another object of the present invention is to provide a system which would provide access to historical information such as time sheets, event logs, and alert logs to designated personnel.

Yet another object of the present invention is to provide a means of communication via the Internet with a central console monitoring application.

Still another object of the present invention is to provide a system with failure-resistance and robustness against hardware denials and intentional attacks by providing data backup on both facilities site and at security headquarter levels.

It is yet another object of the present invention to provide a system capable of communicating with preexisting and/or pre-built system configurations to be installed at specific kinds of sites.

It is another object of the present invention to provide a security system which would support several levels of software, users, data, applications and communications, and whereby security tasks are performed and verified by the guard during the guard tour and that information is recorded by the guard in a checkpoint data processing application, then that recorded information is passed to a base station (computer or server) processing application. The ability to provide central monitoring of guard tours is dependent upon novel wearable and hand held devices which are capable of wireless communications with the data processing checkpoint stations.

Briefly, the objects and advantages of the present invention are realized by providing a human-oriented security guard system as the pivotal aspect of the security system, whereby said guards are greatly enhanced by implementation of varying security device and microprocessor technology. The technological aspect of the system is not specific to any devices or equipment currently on the market but would be site specific and would have the option of incorporating pre-existing technology in centralized monitoring of the site. A high level integration enables introduction of novel technology appearing on the market or pre-existing site specific technology into the security system. Supported features of the system include guard tour control system, centralized communication and reporting with headquarters, schedule builder and time recap automation, daily events and incident automation, support of security protocol, optional web access to the base station application, synchronization with headquarters accounting database and centralized connection to existing client's equipment. The primary goal of the system configuration is to make guard tour tasks planned, controlled, monitored, recorded and paid in a highly efficient and effective manner.

Therefore, this new and improved multiple site, readily scalable security system is provided which combines human-based security personnel integrated with a diverse integrated array of fixed and movable electronic security enhancing components, and numerous modes of communications between said components, including hard wired and wireless applications. The security related components include event sensors, identification tracking for people and things, access control devices, security guard wearable computers and hand held computers as well as embedded data processing control and communications systems, with all sensors and sites capable of being monitored by a designated headquarters through checkpoint data processing components and base station components. The security system provides better trained security guards, who are more alert and responsive, and more closely supervised and easily scheduled, enhanced financial monitoring, more accurately paid and costed security services, better archived and reported security related events, as well as being better coordinated with public agencies, enhanced safety, and readily upgraded and integrated with existing and future technologies.

Other objects and advantages of the present invention will become apparent to those of skill in the art upon contemplation of the disclosure herein in conjunction with the drawings as described below.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with the accompanying drawings, wherein.

DESCRIPTION OF THE PREFERRED EMBODIMENTS

Figure 1:
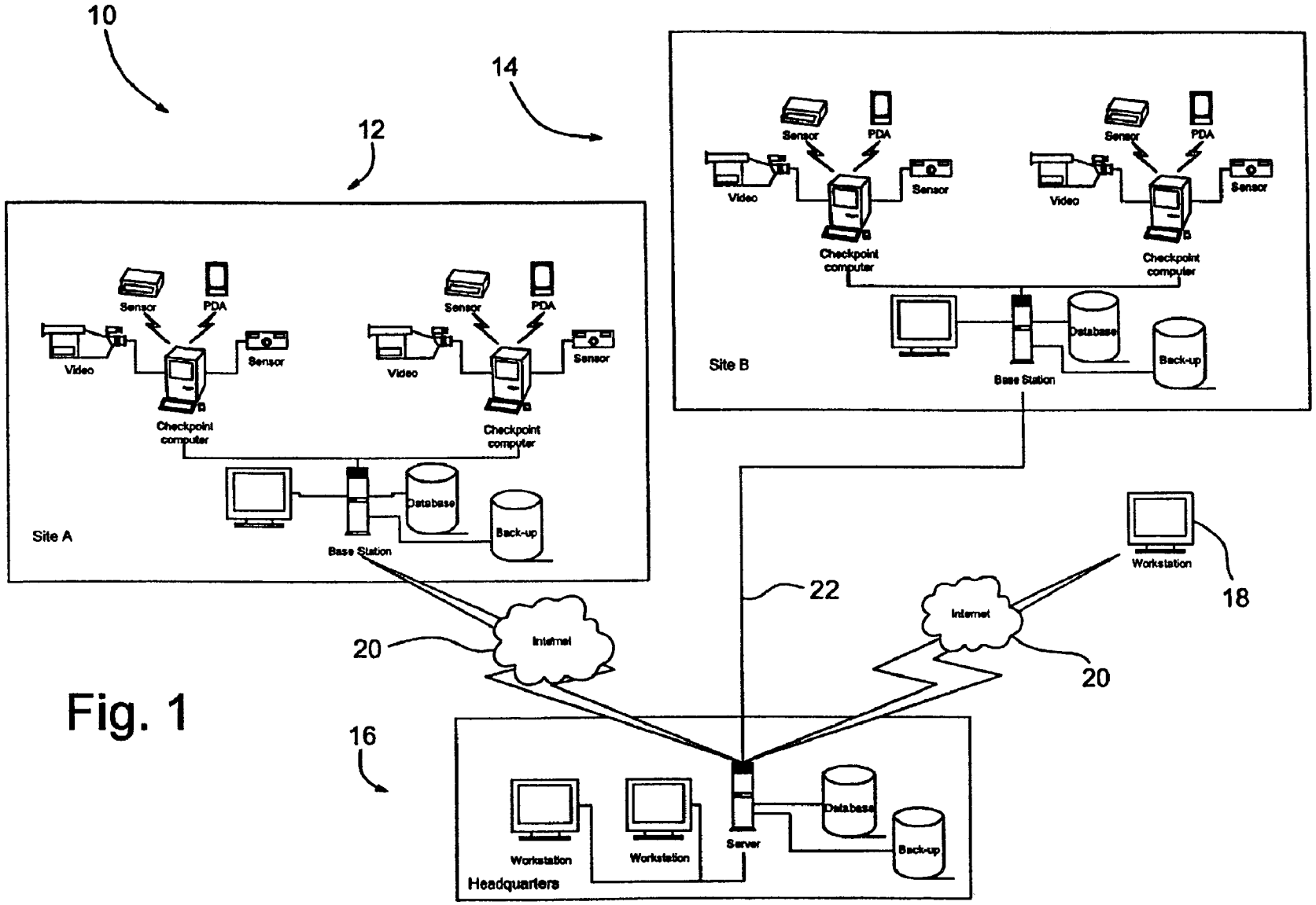
FIG. 1 is a representational diagram of a multiple site integrated security system constructed in accordance with the present invention.

Referring now to the drawings, and more particularly to FIG. 1 thereof, there is shown a new and improved multiple site integrated enhanced human oriented security system 10. Specifically, the multiple site integrated security system 10 as represented by FIG. 1 and constructed in accordance with the present invention, uses direct communication 22 and indirect communication (for example use of a global computer network like the Internet 20) methods of communication between a central headquarters 16 and one or more facilities sites 12 and 14. Direct communication is defined as a point-to-point connection containing a hard wired and/or wireless components in which the sender and receiver are not separated by switching nodes. One example of this is the communication between a wireless transmitter and a wireless receiver. On the other hand, indirect communication can be defined herein as a connection containing hard wired and/or wireless components in which the sender and receiver are separated by switching nodes. This is best exemplified by a local area network (or LAN) and a global computer network like the Internet.

The new multiple site integrated security system 10 may be tailored to site specific needs or pre-existing hardware and equipment as represented by a Site A security subsystem 12 and a Site B security subsystem 14. The sites may be in communication with the integrated headquarters server subsystem 16 by means of direct communication 22 as exemplified by communication with the Site B security subsystem 14. This direct communication 22 between the sensors and the checkpoint data processing subsystems, and between the checkpoint data processing subsystems and the base station CPUs may also be accomplished through the use of existing electrical power lines located at the guarded facility or site.

In the alternative, communication with the integrated headquarters server subsystem 16 may be accomplished via a global computer network, such as the Internet, as exemplified by communication between the integrated headquarters server subsystem 16 and the Site A security subsystem 12. Furthermore, it is contemplated that said communications made be via a global orbiting satellite system (such as the existing global positioning satellite or GPS system) or a similar high altitude or outer space vehicle sensing the data transmissions. Moreover, any energy transmission may be used by the security system, for example, including but not limited to shortwave, long wave, microwave, X-ray, gamma ray, radio frequencies, and cellular telephone frequencies.

Figure 2:
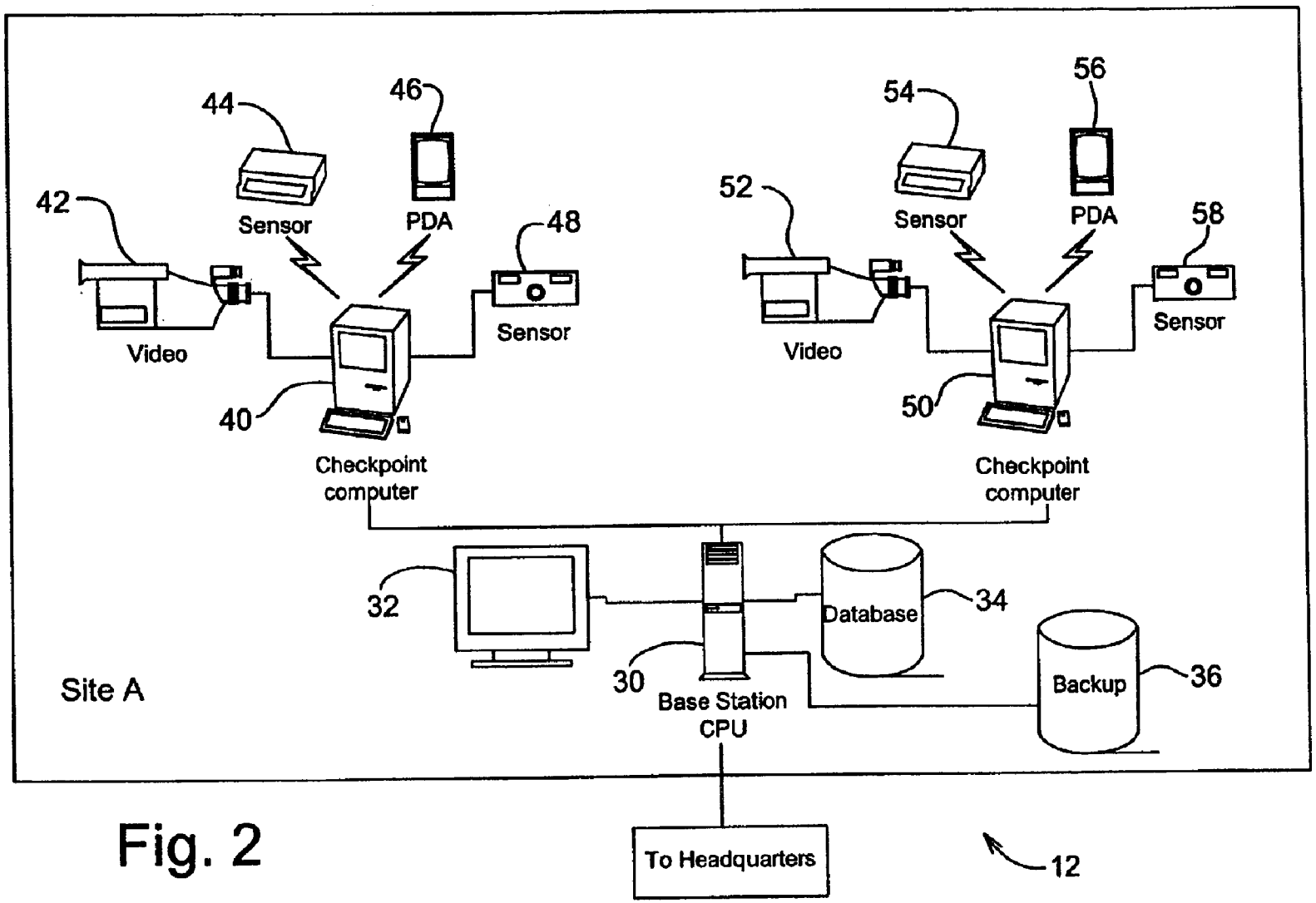
FIG. 2 is an enlarged detailed diagram of a communications scheme between multiple checkpoint data processors and a central base station CPU, constructed in accordance with the present invention.

Turning now to FIG. 2, there is shown a more detailed view of the Site A security subsystem 12. The base station central processing unit (or CPU) 30 is in communication with checkpoint data processors or computers as exemplified by checkpoint computer 40 and checkpoint computer 50. The checkpoint data processing subsystems 40 and 50 are installed in a local area and connected to all hardware devices providing security in this area. The checkpoint data processing subsystems 40 and 50 collect information from wireless sensors 44 and 54, and other peripheral equipment such as wireless personal digital assistant (or PDA) 46 and 56, hard wired sensors 48 and 58 and hard wired video cameras 42 and 52. Hard wired sensors 48 and 58 may be pre-existing units, or in the alternative, may be off the shelf security equipment designed to be installed and operated as motion sensors, heat sensors, etc. Moreover, it is contemplated that the video transmission feeds may come from both hard wired video cameras such as 42 and 52 as shown, or from wireless video feeds (not shown). In some instances, automated video monitoring may be employed at the checkpoint level, or in the alternative, at the base station level of architecture.

The checkpoint data processing subsystems 40 and 50 then process all of the information gathered from any peripheral equipment as exemplified by 42, 44, 46, 48, 52, 54, 56, and 58, and transmits the event sensor information to the base station computer or CPU 30. The base station computer or CPU 30 accepts information from all checkpoint data processing subsystems 40 and 50, and any others in communications therein, stores the information in a database 34, provides access to this information to personnel in real-time mode and generates alerts if indicated by alert logic. Activity on the base station may be monitored in real time via a workstation monitor 32 or remotely (see FIG. 3 below). Furthermore, it is contemplated that checkpoint data processing subsystems 40 and 50 may not be computers in the literal sense, but may be replaced in certain situations with data processing units of varying sizes, complexities and configurations.

Figure 3:
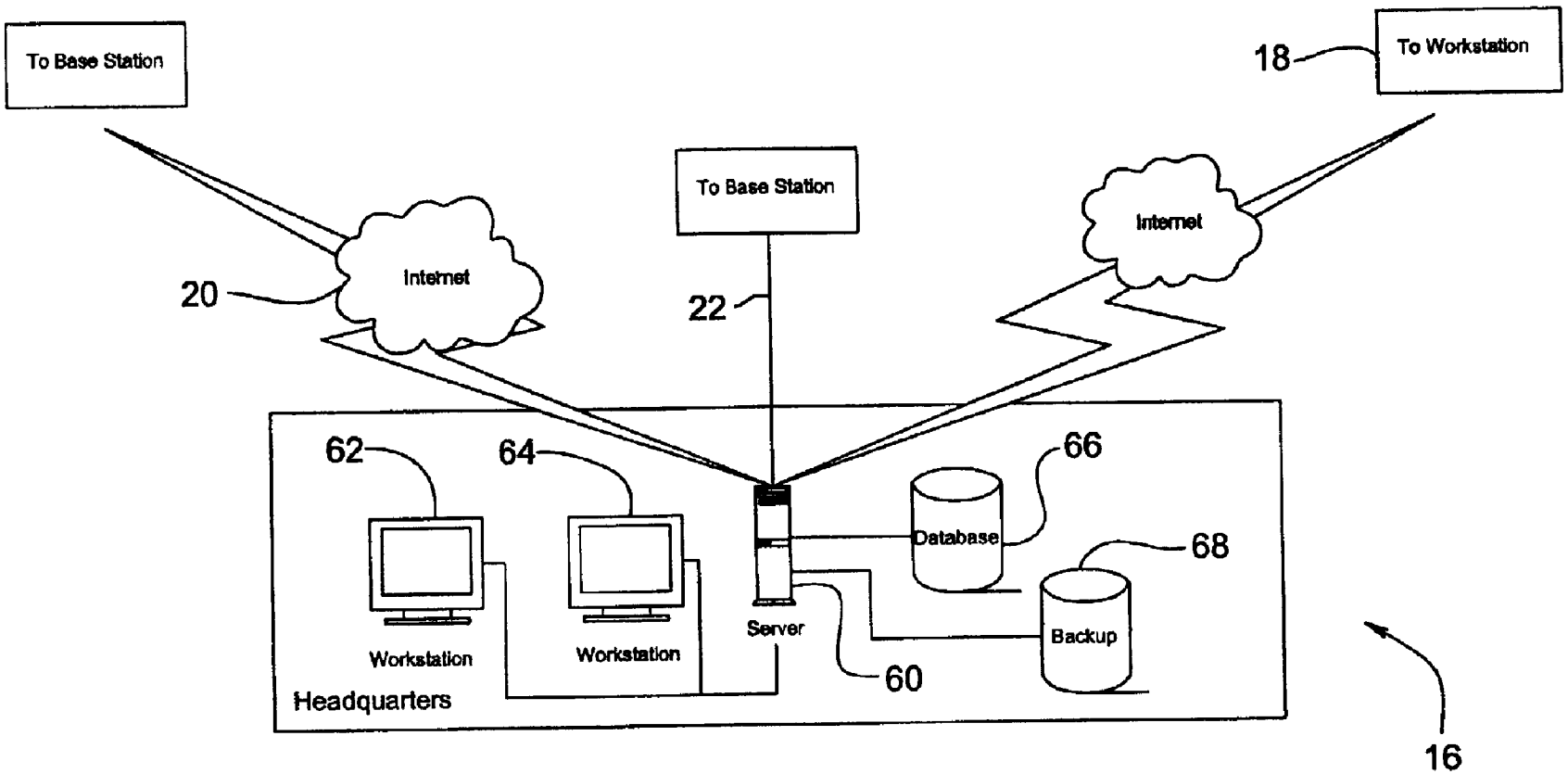
FIG. 3 is a enlarged detailed diagram of a headquarters server with multiple workstations and hard wired as well as global computer network communications capabilities, constructed in accordance with the present invention.

FIG. 3 illustrates a representational diagram of the integrated headquarters server subsystem 16. The headquarters server 60 is in communication with one or more of the base stations by means of a global computer network such as the Internet 20 or via a hard wired connection 22. The information from the headquarters server 60 may be viewed at headquarter workstations 62 and 64 or at widely remote workstations 18 by means of a global computer network (such as the Internet, satellite feeds) or by any other hard wired and/or wireless means.

The server subsystem 16 comprises a database memory unit 66 and a back-up database memory unit 68. All of the information generated by all other components of the security system 10 are stored within the database memory unit 66 and further backed up within database memory unit 68. This enables generation of reports aimed at the scheduling, planning, monitoring, controlling, tour event recording, sensed event recording and paying of human security guards on duty at all of the guarded facilities (Site A, Site B, etc.) and other monitored sites. Furthermore, real time monitoring of events within secure facilities is recorded to enable faster, more effective use of guard supervision, decision making, intrusion intervention and deployment, among many other contemplated guard tasks.

Figure 4:
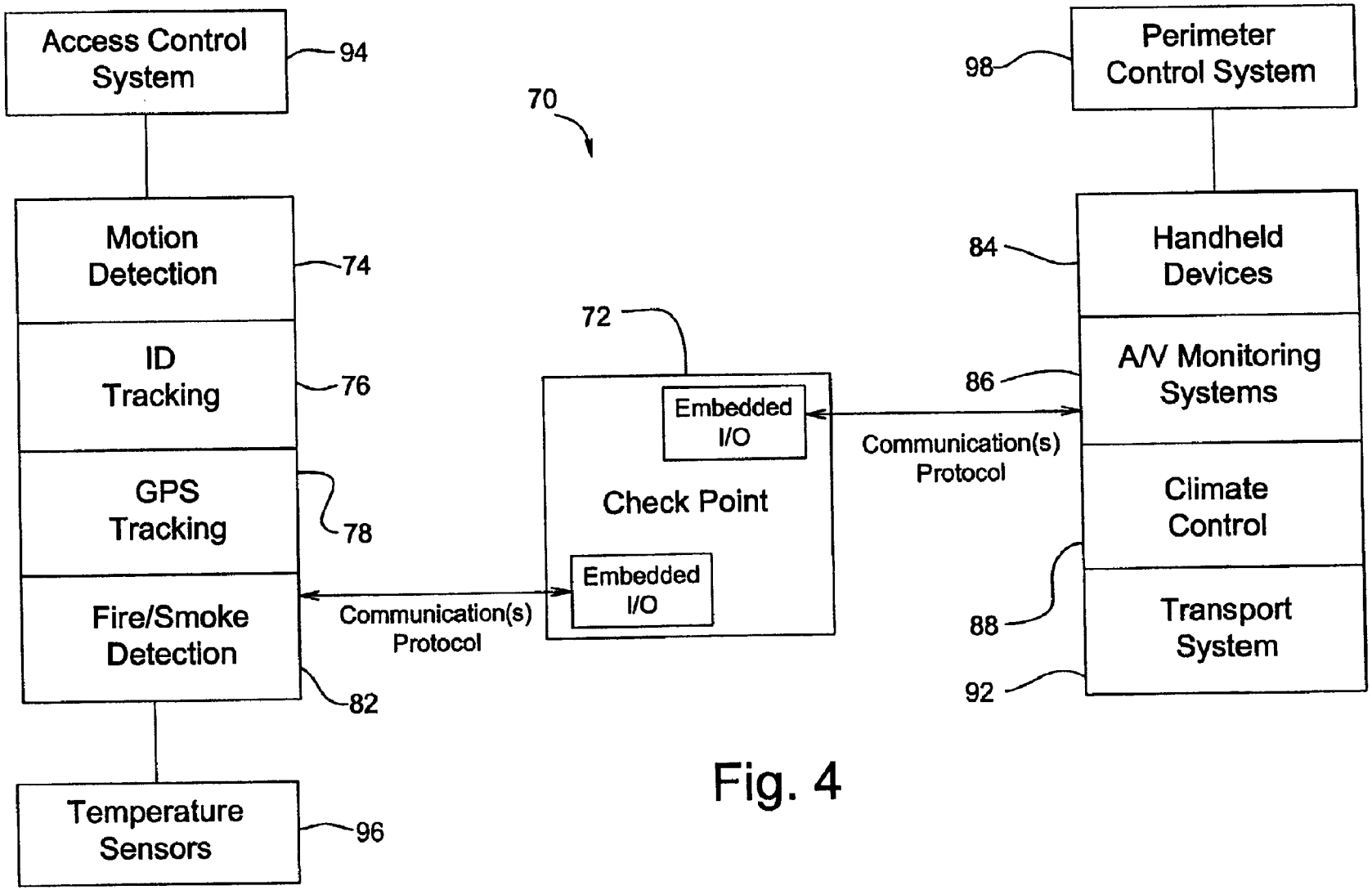
FIG. 4 is a block diagram of the checkpoint data processing architecture and communications system between the security system event sensors and said checkpoint data processor, in greater detail, constructed in accordance with the present invention.

A schematic diagram of checkpoint computer communications options 70 is illustrated in FIG. 4. Another embodiment of a checkpoint computer 72 receives and records information from peripheral event sensor equipment. Most of these devices, such as an access control system 94 coupled with a motion detection device 74, an identification or ID tracking device 76, an GPS tracking system or tracking device 78, a temperature sensor 96 coupled with a fire and smoke detection device 82, perimeter control systems 98, a hand held device 84 such as various security guard communications equipment or a PDA-type device, video camera subsystems 86, climate control subsystems 88 such as heating ventilating and air conditioning (HVAC) subsystems, and transport subsystems 92 such as elevator control device, will all send information instantly and simultaneously to the checkpoint computer 72 by means of a security system communications protocol through an embedded Input/Output (I/O) microprocessor, as shown within the checkpoint computer 72.

Site specific communication protocols, to collect data from sensors, will be developed and deployed for each project. The universal communications protocol, comprised of an encrypted XML-enabled proprietary software program, will direct communications between the checkpoint data processing subsystems or checkpoint computers and the base stations as well as any headquarters servers deployed within the system (see FIG. 5 and FIG. 6 below).

Figure 5:
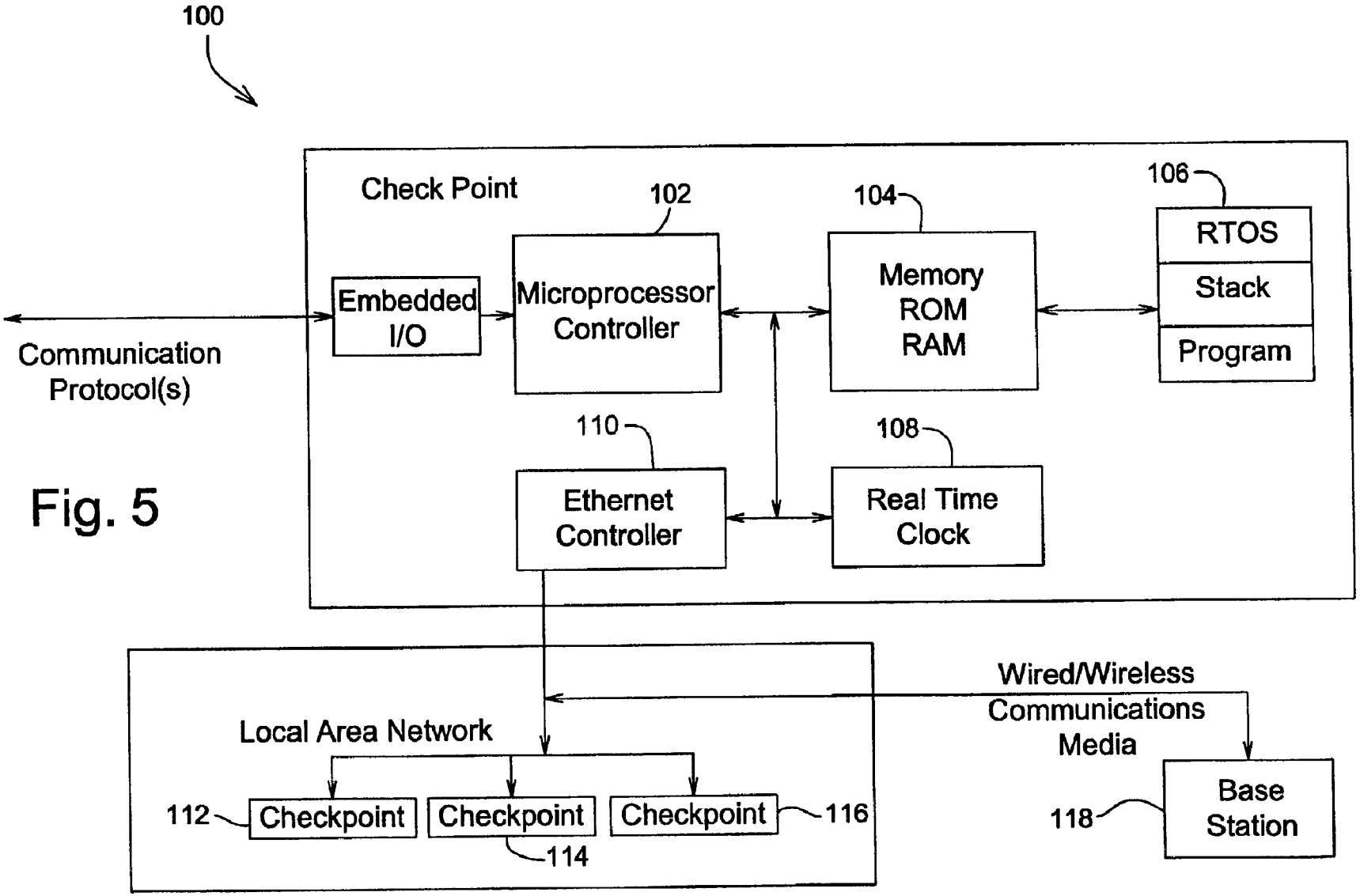
FIG. 5 is a block diagram showing the checkpoint hardware architecture in greater detail, including communications routes between numerous checkpoint data processing units and a base station, constructed in accordance with the present invention.

FIG. 5 is a block diagram of a checkpoint computer hardware architecture in greater detail 100. The CPU microprocessor controller 102 converts the incoming and outgoing signals by means of application software which is stored in the memory (ROM and RAM) 104 of the checkpoint. The real time operating system RTOS/Stack/Program module 106 and the real time clock 108 will run the software independently. Each checkpoint 100 will be equipped with an Ethernet controller 110 on site to interface with other PC systems 112, 114, and 116 such as sensors, controllers and other devices.

Communications within the local area network (LAN) linking the checkpoint data processing subsystems together, and the base station CPU 118 is accomplished either by means of hard wired or wireless communications media. It is also contemplated that these communications may be directed over existing power lines in and around the guarded facilities. By using the existing power supply and routing lines, the security system can be readily integrated into almost any environment, facility or site which includes any existing power supply lines into or out of the building, campus or complex.

Figure 6:
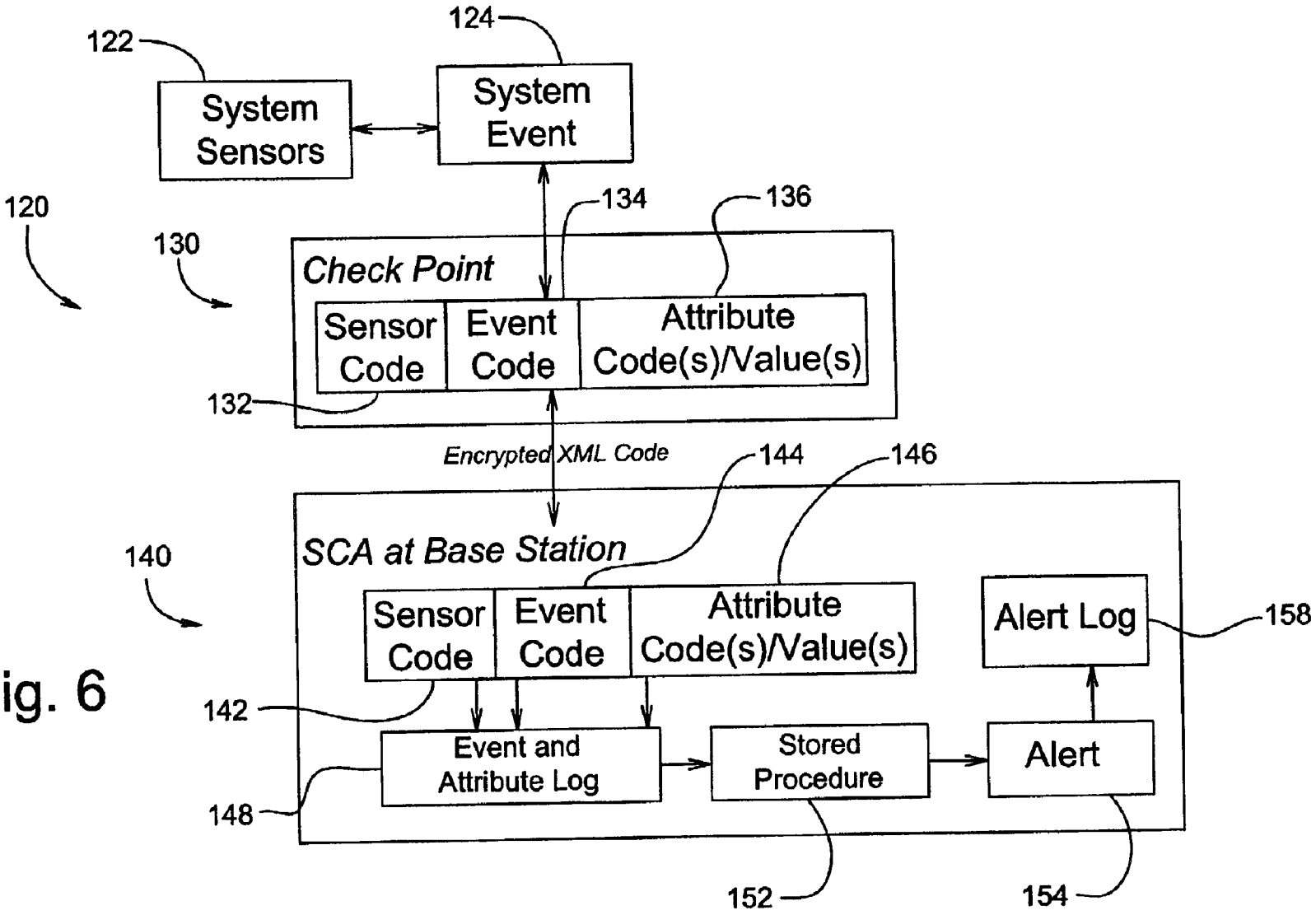
FIG. 6 is a block diagram of an integrated security system encrypted XML communications protocol illustrating communications between system sensors, checkpoint data processing units and the system core application at a base station, constructed in accordance with the present invention.

Turning now to FIG. 6, there is illustrated a block diagram of an integrated security system encrypted XML communications protocol 120 exemplifying communications between checkpoints and the system core application at a base station, as constructed in accordance with the present invention. The system sensors 122 communicate any (and all) system event 124 to a checkpoint 130 via a custom protocol. A sensor code 132 identifies the sensor device that transmitted the system event 124. An event code 134 identifies the actual event and attribute code(s) and value(s) 136 together describe software values for the system event 124 and each individual system event as reported. Each system event 124 can have several attributes. The value of an attribute could be anything from an integer, a string, an image or other data file.

The attribute code(s) and value(s) 136, together with associated sensor code 132 and event code 134 for a given system event 124, are detected and processed by the checkpoint encrypted XML communications protocol software which generates the encrypted XML message which can then be transferred over the network, LAN or a global computer network such as the Internet. After the encrypted attribute code(s) and value(s) 146, sensor code 142 and event code 144 have been received by the security system core application (shown as SCA in FIG. 6) at the base station (shown as Base Station in FIG. 6) 140, the SCA at Base Station will process and decrypt the incoming XML message. The event code 144 and the sensor code 142 will generate an event in the event log and attribute log 148.

Meanwhile, a stored procedure 152 will process the new record in the event log and attribute log 148. For example, the stored procedure 152 will compare the attribute code values to those of the alert values stored in the database and generate an alert 154 accordingly. The alert 154 is then stored in the alert log 158. With the three basic elements, sensor code 132, event code 134 and attribute codes 136, it is possible to describe the communication between the base station CPU 30 and the checkpoint computer 40 for any type of device. Therefore, once programmed, using the encrypted XML protocol 120, the integrated security system can communicate with any off the shelf security device, such as motion sensors, etc., as well as with any facilities subsystem monitoring devices, such as climate control or fire and smoke detection devices.

Figure 7:
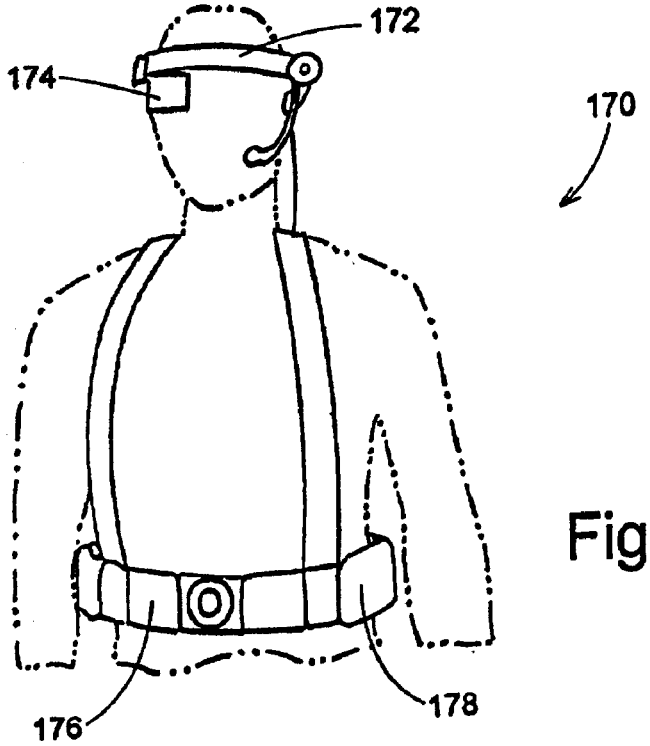
FIG. 7 is a front view of one embodiment of a guard wearable event sensor device including wireless communications equipment, constructed in accordance with the present invention.

FIG. 7 is a front view of guard wearable equipment 170. Guard wearable and/or guard carried communications devices are a key component in the instant multiple site integrated security system 10. It is contemplated that the guard wearable communications and/or computer equipment may be in the form of a belt and suspenders assembly, or, in the alternative, as a guard wearable garment, such as a vest or overcoat, which covertly contains the guard communications and computer equipment. Here, is illustrated but one of many possible embodiments of said guard wearable computer and communications equipment that would be integrated into the overall security system, and act as a monitoring event sensor for detecting the location and condition of the human security guard, Within this embodiment, a headset with microphone, earphone and integrated video camera 172 and an attached see-through display screen 174 are shown. The belt and suspenders assembly 176 supports both a wearable computer 182 linked via wire or wireless means to the headset with microphone, earphone and integrated video camera 172 and display screen 174, and one or more portable power sources, such as batteries as exemplified by battery pack 178.

Figure 8:
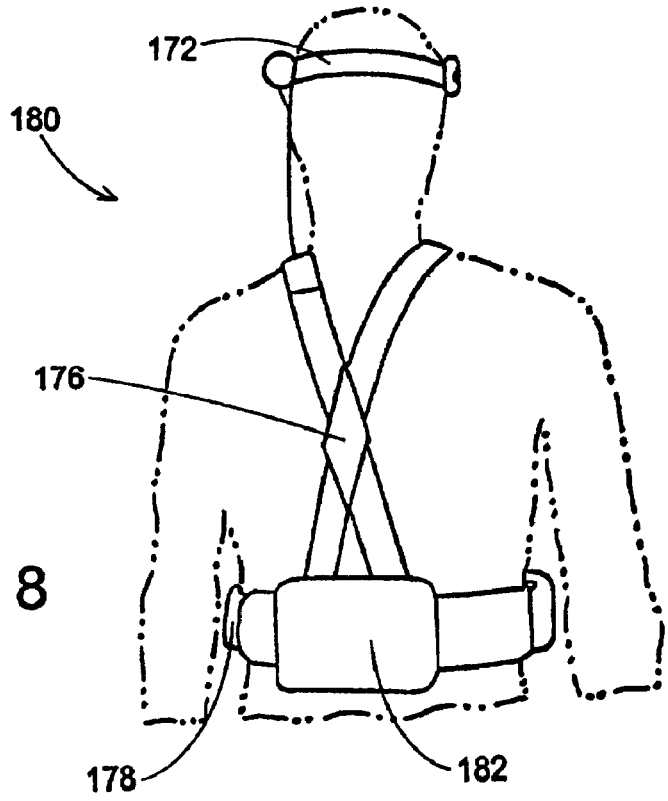
FIG. 8 is a rear view of the embodiment illustrate in FIG. 7, showing a guard wearable event sensor device including wireless communications equipment, constructed in accordance with the present invention.

Referring now to FIG. 8, a rear view of guard wearable security system equipment 180 is illustrated. The belt and suspenders assembly 176 is providing support for a wearable computer (CPU) 182. The guard enters and receives information from the wearable computer (CPU) 182 by means of the headset with microphone, earphone and integrated video camera 172 and an attached see-through display screen 174, as illustrated partially here in FIG. 8 and more so in FIG. 7.

It is also contemplated that the entire apparatus may be incorporated into a single garment, such as a vest or other wearable piece of clothing. Furthermore, all of the equipment may be concealed within that garment so that said equipment does not interfere with standard issue guard equipment, such as items normally worn on a belt, for example a sidearm, ammunition magazines, baton, mace canister, etc.

EXAMPLES OF SECURITY SYSTEM OPERATION ON DIFFERING SCALES

In operation the aforementioned multiple site integrated security system can be readily scalable to be effectively and efficiently deployed in an almost infinite array of facilities and sites security demands situations. An overview of examples of the scalability, adaptability and adjustability and case-by-case integration of the instant security system, constructed in accordance with the present invention, to widely varying site specific challenges are given below. Each specific site for guard monitoring, and security servicing is first fully analyzed and then evaluated to determine the processes required by the site, and which of these processes can be generalized, and which are necessarily site specific.

The processes reviewed for each site are as follows:

1. Scheduling
2. Reporting and requests
3. Event handling
4. Logging
5. Logging of daily activities such as incidents, sign in and sign out, and other activities
6. Site specific improvements and problems.

Next, the scheduling and event requirements are determined and an evaluation of the current problems and points of improvement for security purposes are conducted.

Example I

High Rise Tower Building Security (30–100+ Floors)

In this example, a high rise tower building with 34 floors is located in a relatively congested urban location within the downtown area of a major city, and is attached to a hotel. The same high rise tower structure is also accessible from a symphony hall.

Personnel

The security staff is trained for the site and any new employee will go through extensive site training following the "Site Training Check List". The security staff will include one site manager (S/m), one site assistant (S/a) and 8 officers (S/o) assigned to the building.

The employees will use word processed and hand written documents for daily logging and scheduling. An overview of these documents is shown in Table 1. These documents can be divided into 5 categories:

1. Reports
2. Log files
3. Requests
4. Schedules
5. Dictionaries

From the reports, five categories are reported to Headquarters (HQ).

1. Payroll recap
2. Site Termination Notice
3. Request for wage rate change, bonus or personnel information
4. Quarterly Employee Evaluation Report
5. Disciplinary action report Scheduling Three shifts are assigned per day, from 0300 to 1100, from 1100 to 1900 and from 1900 to 0300. An overview of daily shifts is recorded in the "Daily Shift Schedule".

Before and after each shift, the officer (S/o) fills in the "Time Card". The site manager (S/m) then updates the "Payroll Cap" according to the time cards.

There are between 75 and 100 "Deggy Points" located on the 34 floors in the building. The "Deggy Points" function as checkpoints for the officers. The officers have to go to every checkpoint in the building during their shift. They can do so in random order. Usually one patrol will take between 1 and 1.5 hours. At the end of each officer shift an overview of the checked Deggy Points is downloaded in the computer and presented in the "Deggy Corp/Collects Pen" document. The site manager (S/m) can then verify if all the checkpoints are passed.

Next to the "Deggy Points", there are several other sensors for evaluating the building status. Those include:

1. Fire/water alarms. These include three types of detectors: water, smoke and door pull detectors. The information concerning the status and location of these detectors is available in the main lobby.
2. Door sensors. There are approximately 15 door sensors that will indicate any unusual door activity by activating an alarm. These door sensors are located near exits.
3. Cameras. Cameras are located throughout the building and are recorded 24 hours a day in a sequential order.
4. Engineering. These include sensors that are related to systems active in the building such as HVAC.

Event Logging and Handling

Several types of events are logged and stored. These are examples of those events:

1. Time Registration. Each employee fills in a time card which has information concerning the time frame that the employee was on duty.
2. Daily Activities. All events will be logged into a Daily Activity Log by the site manager (S/m) or the site assistant (S/a).
3. Incidents. An incident includes any unusual event, whether physical or material, that is related to the site. All incidents of relevant importance are handled at the base station first. The base station is located at the lobby of the high rise. The base station is manned seven days a week, 24 hours per day. The base station manager, who is either the site manager or site assistant, will be notified of an incident by the officer. The base station manager will have access to the Standard Operating Procedures (SOP) file and will assist the officer during the incident and decide whether to call emergency help. The site manager is always informed during or immediately following the incident.
4. Elevator trouble. Malfunction of the elevators are reported separately. These mechanical difficulties are handled by representatives of the elevator manufacturer.
5. Tenant sign in/out. All tenants that either work or live in the building are required to sign in or out upon arrival or departure. Upon arrival, the site manager or site assistant will check if the tenant has access rights to the room he or she wants to go by referring to the "Overview of Tenants and access rights" document.
6. Loading Dock activity. All activity in the loading/docking area is logged in the "Loading Dock Log". Upon arrival, communication is established with the arriver and the activity is logged. After 5 p.m., no one is allowed in the loading/docking area.
7. Contractor sign in/out. Contractors that are working in the building have to sign in/out as well. If they are using keys, that is logged as well.
8. Key sign in/out. Every person that uses keys must sign them in and out. There are specific key sets that are assigned to specific personnel (janitors for example).

The log attributes are either entered manually in a word processor or handwritten on a log.

Analysis of Problems

1. Pre-existing hardware, such as fire alarms, must be integrated into the system and each piece of hardware must be dealt with separately since each has a different manufacturer.
2. Access in the adjoining hotel and parking lots may not have security officers on duty. This may present problems with security in the high rise.
3. There may be no on site capability for backing up document files. In case of a power loss or computer malfunction, important files could be lost.

Suggested Improvements

1. Automation of daily event logging, scheduling and reporting.
2. E-mail communication to headquarters.
3. Data back up.
4. Improvements to officer tracking system (Deggy points)
5. Possible replacement of current system by RF tracking system
6. Movement tracking in parking lot. Most incidents occur in the parking lot primarily because there is no restricted access to this area and it is open to the public. Improvements in the current surveillance system of this area are therefore required.

The following table (see Table 1.) is a synopsis of the High Rise Tower Security documents.

TABLE 1

| Form | Description | Used by | Category | HQ |
|---|---|---|---|---|
| Time Card | Daily Time registration | S/o | log file | |
| Payroll Recap | Periodic overview of site-staff hours | S/a or S/m | report | Y |
| Daily Shift Schedule | Overview of officers and shifts | S/a or S/m | schedule | |
| Daily Activity Report | Daily log file of events | S/a, S/o or S/m | log file | |
| Daily Security Summary | Daily summary of Narrative of Daily events | S/m | report | |
| Incident Report | Overview of Incident information | S/m | report | |
| Work Order Request | Request for maintenance | S/a or S/m | request | |
| Elevator | Request for mainte- | | request | |

TABLE 1-continued

| Form | Description | Used by | Category | HQ |
|---|---|---|---|---|
| Maintenance Request | nance on elevator | | | |
| Patrol Requirements | List of regular daily patrol activities | S/m | schedule | |
| Weekly Building Inspection | Overview/Report of points in building that need to be checked | S/o | schedule | |
| Deggy Point Hitlist | Overview of Deggy points in building | | dictionary | |
| Elevator Trouble Log | Log file of elevator problems | S/a or S/m | log File | |
| Tenant sign in/out | Overview of tenants in the building | S/a or S/m | log File | |
| Contractor Check In/Key Issuance | Overview of contractors in building and key sets issued to them | S/a or S/m | log File | |
| Janitorial Key Issuance | Overview of key sets issued to janitorial personnel | S/a or S/m | log File | |
| Loading Dock Log | Log of people in docking area and the goods they are carrying | S/a or S/m | log File | |
| Site Termination Notice | Form requesting transfer of site staff | S/m | request | Y |
| Request for Wage Rate Change, Bonus or Personnel Information | Request for wage rate change, bonus or personnel information | S/m | request | Y |
| Quarterly Employee Evaluation Report | Quarterly employee evaluation report | S/m | report | Y |
| Disciplinary Action Report | Report of violation and action taken following employee violation | S/m | report | Y |
| Key Activity Log/Daily Key Activity Report | Overview of key inventory and officer using key | S/o | log File | |
| HVAC Request form | Form used when tenant wants to use air conditioning | S/m or S/a | request | |
| Tool and Equipment Checkout Guidelines | Form used when someone uses a tool that belongs to the building | S/m or S/a | request | |
| Overview of Tenants and Access Rights | Document that has the information of Tenants who have access to certain areas | Building Management | dictionary | |
| Deggy Corp/Collects Pen | Overview of Deggy points that have been accessed by site officers during daily shifts | S/m or S/a | log File | |
| Personnel Activity | Information of new employee assigned to the site | S/m | dictionary | |
| Site Training Check List | Overview of attributes before a new employee is allowed to man a shift by himself | S/m or S/a | dictionary | |

Example 2

Medium Size Office Building (5–10+ Floors)

A medium size office building is located in a downtown area. The site consists of a building, parking lot and trolley platform. Thirteen officers are assigned to the site with one site supervisor and one supervisor assistant. The property manager is on site during the day. The daily schedule is divided into three shifts, a day shift, a swing shift and a graveyard shift. There are site officers who patrol and site officers that occupy the console.

All employees, tenants and contractors have card keys to access certain areas in the building. The card key system is used for three purposes:

1. Entry authorization
2. Person identification
3. Guard tracking

After hours and on weekends, all personnel must sign in and out as well as use the card key for safety reasons.

All entries with the card key are recorded in a log file, which identifies the location, time and person using the card. This also allows tracking of the site officer as well. An officer usually patrols the ground level, but will occasionally escort people or check other sites such as the roof.

The site supervisor is the main decision maker. In case of an incident, the site supervisor will be contacted. The site supervisor in turn will contact any emergency personnel required.

Most forms are hand written and if needed, may be faxed to the headquarters.

On site Internet access is available, however, the systems belong to the property owner.

Scheduling, Event Logging and Handling

Scheduling is similar to that used for the High Rise Tower security system. Each employee uses time cards and the site manager creates the schedule accordingly. The card key log file is then used as a back up system. In case an officer doesn't show up, the site officer on duty must make sure that he is relieved from duty by another site officer. Usually, the site officer on duty will log extra hours and call the site supervisor for a relief site officer.

Event logging is also similar to that used in the security system for the High Rise Tower. The site officers are required to fill in the daily log. In case of an incident, the site manager and the site officer write an incident report. The use of the card key system replaces the use of the Deggy point system in the High Rise Tower security system. The advantage of the card key system is that it can be used for entry authorization as well as for personnel identification and access authorization.

Analysis of Problems

1. The site is provided with pre-existing hardware for alarm, monitoring and tracking. Integration of these systems is difficult and each must be integrated separately.
2. Since a portion of the computerized system is owned by a third party, authorization from third parties is needed (e.g. access of SOP)

Suggested Improvements

1. Automation of daily event logging, scheduling and reporting
2. E-mail communication to headquarters
3. Card keys are expensive to replace ($7–$12)

The following table (see Table 2.) is a synopsis of the Medium Size Office Building documents.

TABLE 2

| Form | Description | Used by | Category | HQ |
|---|---|---|---|---|
| Time Card | Daily Time registration | S/o | log file | |
| Schedule | Overview of weekly employee schedule | S/m | schedule | |
| Indemnity, Defend and Hold Harmless Agreement | Release form for possibly dangerous activities (e.g. someone wishes to take pictures on the roof) | All | report | |

TABLE 2-continued

| Form | Description | Used by | Category | HQ |
|---|---|---|---|---|
| Request for wage rate change, bonus or personnel information | Request for wage rate change, bonus or personnel information | S/m | request | Y |
| Personnel Information | Information | | | |
| Vacation/Time Off Request Form | | | request | Y |
| Personal Injury Report | Used only for site officer injuries | S/m or S/o | | Y |
| Do It Please | Request form for Headquarters. Can be used for anything | S/m | request | Y |
| Disciplinary Action Report | Report of violation and action taken following employee violation | S/m | report | Y |
| Payroll Pickup Authorization | Request form used for sending all payroll checks to a particular site where it is picked up by one person | all | request | Y |
| Payroll Discrepancy Form | Used when there is a problem with payroll (sent with a copy of the discrepancy) | S/m | request | Y |
| Payroll Recap Exceptions | Overview of exception to the scheduled shift such as overtime | S/m | report | Y |
| Request for Extension of Temporary Guard Card | Form used for applying for guard card for new employee | S/m | request | |
| Voluntary Witness Report | Witness of incident report | witness | | Y |
| Site Termination Notice | Form requesting transfer of site staff | S/m | request | Y |
| Guard Request Form | request for a new guard | S/m | request | Y |
| Exceptional Transaction Report | Form used for payment in unusual circumstances (e.g. for lost parking ticket) | S/m | report | |
| Property Damage/Loss Report | Property damage or loss report | all | report | |
| Payroll Recap | Set of four reports for tracking of employee hours | S/m | report | Y |
| Incident Report | Overview of Incident information | S/m | report | |
| Tour Schedule | Schedule of tour to be made by site officers | S/m | schedule | |
| Assignment Sheet | Schedule of tour to be made by officers | S/m | schedule | |
| Swipe Guard Log | Log file of all swipe card activities | | log file | |
| Patrol Log | Log file kept by officers | S/o | log file | |
| Autopark Inventory Sheet | Overview of vehicles that are in the building at night | S/o | report | |
| Sign In Sheet | Sign in sheet for persons in the building after 1800 hours | All | log file | |
| Weapons Log | All persons entering building are searched for weapons (except guards and card key holders) | All | log file | |
| Equipment Checkout Form | Form for checking out building equipment | S/m | log file | |

TABLE 2-continued

| Form | Description | Used by | Category | HQ |
|---|---|---|---|---|
| Key Control Log | Overview of information on personnel with specific keys | S/m | log file | |
| Janitors Log | Overview of janitor key information | S/m | log file | |

Example 3

Single Story Business Plaza (5–100+ Businesses)

In this example a single story business plaza is guarded by a single or numerous security officers. The twenty-four hour period is divided into three shifts. All officers report incidents to the site supervisor who then establishes what to do and whether to contact emergency personnel. All documents are handwritten and there are no electronic sensors or cameras on site to provide additional information.

The site supervisor is responsible for the single story business plaza as well as two nearby sites.

Time in and out for officers is registered on two systems on site. An electronic system is used for actual time registration at headquarters. The officers use specified public telephones to sign in and out of their shifts. The site supervisor keeps track of the time sheets as well for backup purposes. These time sheets are filled in manually.

Each business in the plaza is assigned a number. When the business pages a site officer, the number for that business is displayed and the site officer will inspect the specific business accordingly. A mobile phone is transferred from one site officer to another at the end of each shift. This mobile phone contains the most important phone numbers.

Scheduling, Event Logging and Handling

Scheduling is done on a weekly basis and is handwritten. The site supervisor schedules for the business plaza as well as the two neighboring sites.

Event logs are kept on a daily basis. Events and activities are handwritten on the event log. In case of an incident, the site supervisor will write an incident report. Requests are made by telephone.

Analysis of Problems

1. The site is divided by a building with a front and back. Since there is only one site officer on site, only the front or back can be supervised at any time.
2. Electronic time clocking through the telephone system is unreliable at times.
3. The SOP assigned to the site is out of date.

Suggested Improvements

1. Security cameras
2. Tracking system for site officer. This currently has a low priority.
3. SOP updated for the site.
4. Scheduling and reporting could be automated, but for this site, it is questionable if this would improve site management.

The following table (see Table 3.) is a synopsis of the Single Story Business Plaza documents.

TABLE 3

| Form | Description | Used by | Category | HQ |
|---|---|---|---|---|
| Time Card | Daily Time registration. This is for back up purposes. Actual time registration is done by a clocking system by telephone | S/o | log file | |
| Schedule | Weekly overview of officers and shifts. There is one schedule for all three sites | S/m | schedule | |
| Incident Report | Time and description of incident | S/m | report | ? |
| Daily Log | Overview of daily site activities and events | S/m and So | log | |
| Security Activity Summary Data | Overview of all incidents within a certain time frame | S/m | report | |

It should be understood, however, that even though these numerous embodiments, examples, characteristics and advantages of the invention have been set forth in the foregoing description, together with details of the structure and function of the invention, the disclosure is illustrative only, and changes may be made in detail, especially in matters of shape, size, components, configuration and arrangement of parts within the principal of the invention to the full extent indicated by the broad general meaning of the terms in which the appended claims are expressed.

What is claimed is:

1. A guard enhancing multiple site scalable integrated security system comprising:

(a) one or more human guards patrolling one or more sites for the purpose of monitoring the security of said site or sites;

(b) event sensor means, including sensor devices for the purpose of detecting events of human intrusion and movement within said site or sites, and changes in site control and warning subsystems;

(c) one or more variably located checkpoint data processing subsystems in direct communication with said event sensor devices for the purpose of monitoring detected events and reporting same;

(d) one or more base station central processing units (CPUs) for processing site level information derived from said one or more variably located checkpoint data processing subsystems, whereby said checkpoint data processing subsystems are programmed to translate variable language data coming from said event sensor means into one universal language which is then communicated between said checkpoint data processing subsystems and said base station central processing units; and (e) a centrally located headquarters CPU server subsystem in communication with said variably located checkpoint data processing subsystems via said base station CPU, whereby said checkpoint data processing subsystems monitor said event sensors to log events in real time and report events in real time then convey security system status to said centrally located headquarters CPU server subsystem through said base station CPU, for the purpose of facilitating human guard supervision, human guard situation analysis, possible human guard intervention and human guard decision making regarding security countermeasures.

2. The guard enhancing multiple site scalable integrated security system according to claim 1, wherein said event sensor means are sensor devices which are controlled through wireless communications protocols.

3. The guard enhancing multiple site scalable integrated security system according to claim 1, wherein said event sensor means are sensor devices which are controlled through hard wired communications protocols.

4. The guard enhancing multiple site scalable integrated security system according to claim 1, wherein said event sensor means includes conventional motion sensing devices.

5. The guard enhancing multiple site scalable integrated security system according to claim 1, wherein said event sensor means includes conventional radio frequency tracking sensing devices.

6. The guard enhancing multiple site scalable integrated security system according to claim 1, wherein said event sensor means includes conventional identification tracking sensing devices, including sensing devices which communicate via a global positioning satellite (GPS) system or a similar high altitude or outer space vehicle sensing the data transmissions.

7. The guard enhancing multiple site scalable integrated security system according to claim 1, wherein said event sensor means includes conventional fire and smoke detecting sensing devices.

8. The guard enhancing multiple site scalable integrated security system according to claim 1, wherein said event sensor means includes conventional audio systems and video camera systems for transmitting and analyzing auditory and visual signals devices.

9. The guard enhancing multiple site scalable integrated security system according to claim 1, wherein said event sensor means includes conventional climate control systems, including heating ventilation and air conditioning (HVAC) system sensing devices.

10. The guard enhancing multiple site scalable integrated security system according to claim 1, wherein said event sensor means includes conventional elevator sensing devices.

11. The guard enhancing multiple site scalable integrated security system according to claim 1, wherein said event sensor means includes conventional energy sensing devices, including conventional power source and conventional power supply sensing devices.

12. The guard enhancing multiple site scalable integrated security system according to claim 1, wherein said event sensor means includes human security guard wearable sensing devices having microprocessor control and wireless communications capabilities.

13. The guard enhancing multiple site scalable integrated security system according to claim 12, wherein said human security guard wearable sensing devices having microprocessor control and wireless communications capabilities, further include said guard wearable sensing devices capable of communicating via a global positioning satellite (GPS) system or a similar high altitude or outer space vehicle sensing the data transmissions.

14. The guard enhancing multiple site scalable integrated security system according to claim 12, wherein said event sensor means includes human security guard hand-held portable communications equipment.

15. The guard enhancing multiple site scalable integrated security system according to claim 14, wherein said human security guard hand-held portable communications equipment includes a hand-held computer.

16. The guard enhancing multiple site scalable integrated security system according to claim 1, wherein said one or more variably located checkpoint data processing subsystems include conventional ethernet controllers to provide an interface to a monitored site's existing network.

17. The guard enhancing multiple site scalable integrated security system according to claim 1, wherein said one or more variably located checkpoint data processing subsystems include conventional wireless communications controllers to provide an interface to a monitored site's existing network.

18. The guard enhancing multiple site scalable integrated security system according to claim 1, wherein said one or more variably located checkpoint data processing subsystems include conventional hard wired communications controllers to provide an interface to a monitored site's existing network.

19. The guard enhancing multiple site scalable integrated security system according to claim 1, wherein said one or more variably located checkpoint data processing subsystems include communications protocol means for the purpose of interacting with said event sensor means.

20. The guard enhancing multiple site scalable integrated security system according to claim 1, wherein said base station CPU's send checkpoint data processing subsystem information to said headquarters server via conventional wireless communications means.

21. The guard enhancing multiple site scalable integrated security system according to claim 1, wherein said base station CPU's send checkpoint data processing subsystem information to said headquarters server via conventional hard wired communications means.

22. The guard enhancing multiple site scalable integrated security system according to claim 1, wherein said centrally located headquarters CPU server subsystem includes one or more workstations and memory storage means for providing real time event monitoring and simultaneous real time event log recording.

23. The guard enhancing multiple site scalable integrated security system according to claim 1, wherein said centrally located headquarters CPU server subsystem communicates directly with said base station CPU's via a conventional local area network (LAN).

24. The guard enhancing multiple site scalable integrated security system according to claim 1, wherein said centrally located headquarters CPU server subsystem communicates directly with said base station CPU's via a conventional wireless communications protocol.

25. The guard enhancing multiple site scalable integrated security system according to claim 24, wherein said conventional wireless communications protocol includes IEEE 802.11 CCK direct-sequence wireless area network utilization.

26. The guard enhancing multiple site scalable integrated security system according to claim 24, wherein said conventional wireless communications protocol includes a cellular data network and cellemetry utilization.

27. The guard enhancing multiple site scalable integrated security system according to claim 1, wherein said centrally located headquarters CPU server subsystem communicates directly with said base station CPU's via a conventional global computer network, including the global computer network conventionally referred to as the Internet.

28. The guard enhancing multiple site scalable integrated security system according to claim 1, wherein said centrally located headquarters CPU server subsystem communicates directly with a workstation outside the security system via a global computer network, for the purpose of remotely monitoring the security status of a subject site.

29. The guard enhancing multiple site scalable integrated security system according to claim 1, wherein said centrally located headquarters CPU server subsystem communicates directly with a workstation outside the security system via a local area network (LAN), for the purpose of remotely monitoring the security status of a subject site.

30. The guard enhancing multiple site scalable integrated security system according to claim 1, further comprising a guard enhancing human security guard wearable sensing device for covert surveillance, the device having microprocessor control and wireless communications capabilities.

31. A guard enhancing human security guard wearable sensing device according to claim 30, for covert surveillance, said device having microprocessor control and wireless communications capabilities and further comprising:

(a) a headset with a display screen, a microphone, an earphone, and an integrated video camera;

(b) a belt and suspenders assembly which covertly supports said guard wearable communications device;

(c) a compact portable CPU component attached to said belt and suspenders assembly; and (d) one or more portable power sources attached to said belt and suspenders assembly for the purpose of supplying power to said CPU component.

32. The guard enhancing human security guard wearable sensing device for covert surveillance according to claim 31, wherein said belt and suspenders assembly which covertly supports said guard wearable communications device is replaced by a guard wearable garment which covertly supports said guard wearable communications device.

33. The guard enhancing human security guard wearable sensing device for covert surveillance according to claim 31, wherein said human security guard hand-held portable communications equipment includes a personal digital assistant (PDA).

34. The guard enhancing human security guard wearable sensing device for covert surveillance according to claim 33, wherein said personal digital assistant (PDA) includes a PDA with wireless communications capabilities.

35. The method for making a guard enhancing multiple site scalable integrated security system, comprising the steps of:

(a) providing one or more human security guards for the purpose of patrolling one or more subject sites;

(b) providing variably located event detection sensor means within one or more subject sites;

(c) providing one or more variably located intermediary checkpoint data processing subsystems in direct communication with said event sensor means;

(d) providing one or more base station CPU's in direct communication with said checkpoint data processing subsystems; and (e) providing a centrally located headquarters server CPU subsystem which receives site level information from said base station CPU's and allows real time monitoring of events detected within the subject site or sites, to facilitate human guard supervision, human guard situation analysis, possible human guard intervention and human guard decision making regarding security countermeasures.

36. The method for making a guard enhancing multiple site scalable integrated security system according to claim 35, wherein said step of providing said variably located event detection sensor means includes providing event detection devices which communicate via conventional wireless protocols.

37. The method for making a guard enhancing multiple site scalable integrated security system according to claim

35, wherein said step of providing said variably located event detection sensor means includes providing event detection devices which communicate via conventional hard wired means.

38. The method for making a guard enhancing multiple site scalable integrated security system according to claim 35, wherein said step of providing said event detection sensor means includes providing event detection devices which are human security guard wearable sensing devices.

39. The method for making a guard enhancing multiple site scalable integrated security system according to claim 35, wherein said step of providing said event detection sensor means includes providing event detection devices which are human security guard carry-able sensing devices capable of providing wireless communications with said checkpoint data processing subsystems.

40. The method for making a guard enhancing multiple site scalable integrated security system according to claim 39, wherein said step of providing said human security guard carry-able sensing devices capable of providing wireless communications with said checkpoint data processing subsystems, includes providing hand-held computers.

41. The method for making a guard enhancing multiple site scalable integrated security system according to claim 35, wherein said step of providing a centrally located headquarters server CPU subsystem which receives site level information from said base station CPU's includes providing a direct wireless communications protocol for communication between said headquarters server CPU subsystem and said base station CPU's.

42. The method for making a guard enhancing multiple site scalable integrated security system according to claim 35, wherein said step of providing said variably located event detection sensor means includes providing a guard wearable communications device comprising:

(a) a headset with a display screen, a microphone and an earphone;

(b) a belt and suspenders assembly for supporting said guard wearable communications device;

(c) a compact portable CPU component attached to said belt and suspenders assembly; and (d) one or more portable power sources, including battery packs, attached to said belt and suspenders assembly for the purpose of supplying power to said CPU component.

43. The method for making a guard enhancing multiple site scalable integrated security system according to claim 42, wherein said step of providing said variably located event detection sensor means includes providing a guard wearable communications device comprising a wearable garment covertly incorporating said portable CPU component, said portable power supply sources, and a communications device.

44. The method for making a guard enhancing multiple site scalable integrated security system according to claim 35, further comprising the step of providing direct communication with an outside workstation for the purpose of remotely monitoring the security status of one or more subject sites simultaneously.

45. The method for making a guard enhancing multiple site scalable integrated security system according to claim 35, further comprising the step of providing direct communications between said event sensor means, said checkpoint data processing subsystems, and said one or more base stations CPUs via existing electrical power lines in place at one or more subject sites.

* * * * *